United States Patent [19]

Boyer

[11] 4,084,533

[45] Apr. 18, 1978

[54] REVERSIBLE RUBRAIL FOR VESSELS

[75] Inventor: Edward J. Boyer, Attleboro, Mass.

[73] Assignee: Whittaker Corporation, Los Angeles, Calif.

[21] Appl. No.: 779,642

[22] Filed: Mar. 21, 1977

[51] Int. Cl.[2] ..... B63B 59/02

[52] U.S. Cl. ..... 114/219; 52/716; 61/48; 293/62

[58] Field of Search ..... 114/219; 293/1, 62, 293/70, 72, DIG. 4; 61/48; 52/716-718

[56] References Cited

U.S. PATENT DOCUMENTS

| | | | |
|---|---|---|---|
| 1,613,077 | 1/1927 | Bourgon | 293/DIG. 4 |
| 2,161,837 | 6/1939 | Tell | 293/62 |
| 2,263,063 | 11/1941 | Allen | 293/62 |
| 2,990,802 | 7/1961 | Ong et al. | 114/219 |
| 3,065,724 | 11/1962 | Tritt | 114/219 |
| 3,441,305 | 4/1969 | Trammell, Jr. | 293/62 |

*Primary Examiner*—Trygve M. Blix
*Assistant Examiner*—Stuart M. Goldstein
*Attorney, Agent, or Firm*—Donald E. Nist

[57] ABSTRACT

An improved reversible rubrail suitable for use on vessels such as ships, boats and the like comprises an elongated flexible resilient strip having an upstanding rear wall and spaced front walls connected to opposite ends, that is, the top and bottom of the rear wall and extending arcuately forward thereof so that their free ends abut or reversibly overlap and so that they define a covered compressible space or cavity with the rear wall. The free ends of the two front walls are flexible and thus provide access to the compressible cavity so as to permit the rubrail to be easily installed while concealing internal connecting bolts, screws, etc. within the cavity.

An end wall is connected to either the top or bottom of the rear wall and extends rearwardly thereof. The rear surface of the rear wall and one surface of the end wall are flat. These flat surfaces are connected preferably at a 90° angle. The rubrail can be installed on a vessel which either has a deck which overlaps the hull or has the deck flush with the hull. The rubrail is simple, inexpensive, easy to install, effective and is sufficiently flexible so that it can be trained around corners, etc.

8 Claims, 7 Drawing Figures

REVERSIBLE RUBRAIL FOR VESSELS

BACKGROUND OF THE INVENTION

1. Field of the Invention

Present invention generally relates to protective means and more particularly to rubrails for vessels such as boats, ships and the like.

2. Prior Art

The usual type of rubrail which is installed on yachts, power boats and the like to protect their hulls from coming into contact with other boats or with pilings or dock portions, etc., comprises a two-piece construction which is expensive, both from a material standpoint and from a labor standpoint. There is also a problem of disassembling and reassembling the components in the event that they do not fit well enough together. Inasmuch as extensive lengths of rubrail are used in various types of vessel construction, and since they represent a substantial outlay of time and material expense, it would be desirable to provide an improved rubrail which not only would be less expensive and easier to install in a shorter period of time but which could be made in one piece in order to eliminate fitting problems during installation. Ideally, the rubrail should be equally adaptable for use in boats which have an overlapping deck-to-hull construction and in boats which have a flush deck-to-hull construction.

SUMMARY OF THE INVENTION

The foregoing needs are satisfied by the improved reversible rubrail of the present invention. The rubrail is substantially as set forth in the Abstract above. The rubrail is equally useful on boat constructions which are of the flush deck type and those which are of the overlapping deck type. The rubrail is of one piece and can be easily extruded at low cost. It can be rapidly and efficiently installed and operates with a maximum of protection. It includes a compressible pocket or cavity behind the front walls thereof. Screws, bolts or other means such as staples can be used to fasten the rubrail to the hull of the boat. These fasteners can be connected from the cavity through the rear wall of the rubrail and are thus kept out of sight within the cavity. If desired, the free ends of the front walls which overlap or abut can be sealed together to prevent moisture from entering the cavity. The design of the rubrail is such as to effectively reduce the inventory needed for various types of boats. Preferably the rubrail is of flexible resilient material such as rubber which is stiff enough to maintain its integrity but flexible enough to allow the rubrail to be bent around corner curves and the like without the use of heat, special tools, etc. Various other features of the invention are set forth in the following detailed description and accompanying drawings.

DRAWING

Figure 6:
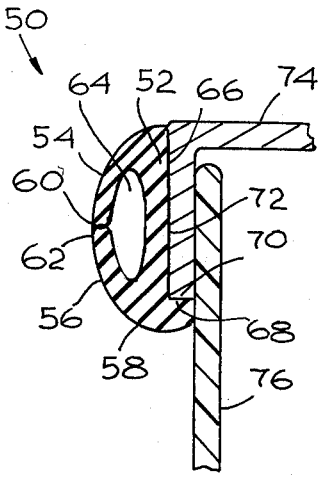
Figure 7:
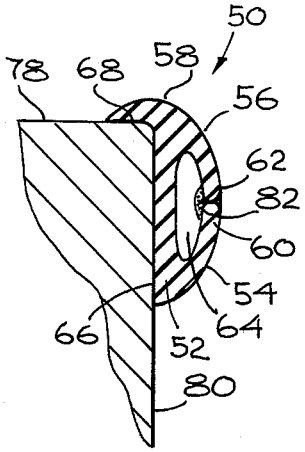

FIG. 6 is a schematic cross section of a second preferred embodiment of the improved reversible rubrail of the invention shown installed on a deck-hull construction of the overlapping deck type; and, FIG. 7 is a schematic cross section of the rubrail of FIG. 6 shown in a position inverted from that of FIG. 6 installed on a deck-hull construction of the flush deck type, with the abutting free ends of the front walls of the rubrail sealed together.

DETAILED DESCRIPTION

FIGS. 1 - 3

Figure 1:
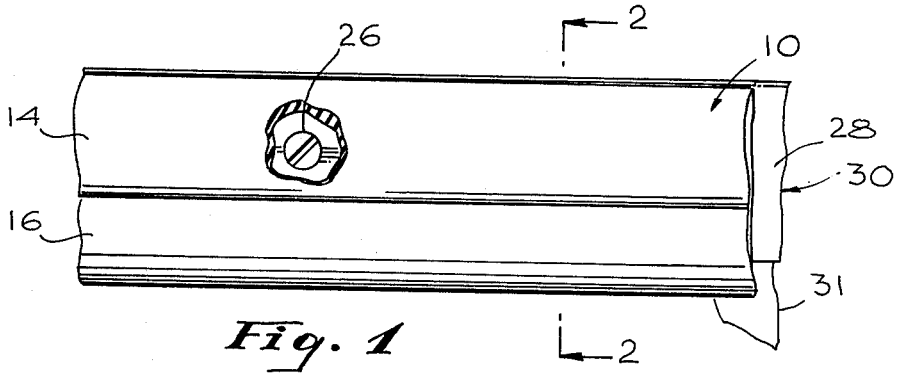
FIG. 1 is a fragmentary schematic front elevation, partly broken away, of a first preferred embodiment of the improved reversible rubrail of the present invention.

Now referring more particularly to FIG. 1 of the drawings, a first preferred embodiment of the improved reversible rubrail of the present invention is shown schematically in fragmentary front elevation. Thus a rubrail 10 is shown which is in the form of an elongated strip having, as shown more particularly in FIG. 2, an upstanding rear wall 12, to the upper and lower ends of which are connected front walls 14 and 16, respectively. Walls 14 and 16 extend forwardly of rear wall 12 and are curved so that their free ends 18 and 20, respectively, overlap, as shown particularly in FIG. 2.

Figure 2:
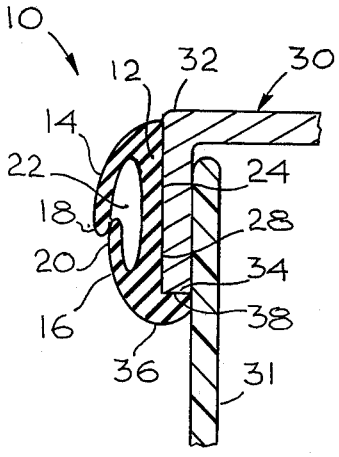
FIG. 2 is a schematic cross section of the rubrail of FIG. 1 taken along the section line 2—2 of FIG. 1, showing the rubrail installed on a deck-hull construction of the overlapping deck type.

Walls 14 and 16 define, together with rear wall 12, a compressible normally closed yet openable cavity 22 in rubrail 10. Walls 14 and 16 are flexible and resilient, as is the remainder of rubrail 10, so that free ends 18 and 20 can be deflected towards rear wall 12 under impact and also can be deflected outwardly when it is desired to expose cavity 22 as, for example, during installation of rubrail 10. For example, as shown in FIGS. 1 and 2, the flat rear surface 24 of wall 12 can be placed against the exterior of a boat so that a plurality of screws 26 may extend from cavity 22 through rear wall 12 and into contact with the depending portion 28 of an overlapping deck 30 of the boat to fasten rubrail 10 in a horizontal position below the upper edge 32 of deck 30 to protect deck 30 and the hull 31 connected thereto.

Rubrail 10 is also designed to protect the lower edge 34 of depending portion 28 of deck 30. In this regard, rubrail 10 includes an end wall 26 connected to one end (in this instance the lower end) of rear wall 12 so as to cover the same. End wall 36 has a flat surface 38 which is adapted to abut lower edge 34. Flat surfaces 38 and 24 join each other, preferably, at a 90° angle. With this configuration, rubrail 10 can be easily, automatically and rapidly installed in the correct position on deck 30.

It will be understood that rubrail 10 can be glued, stapled, bolted and/or otherwise attached to deck 30. Cavity 22 permits mechanical attachments such as screws 26, or bolts, staples and the like (not shown) to be made through rear wall 12 without marring the appearance of rubrail 10 since these attachments are concealed behind walls 14 and 16.

Rubrail 10 preferably comprises synthetic or natural rubber, resilient material such as a flexible plastic or the like which is capable of being bent around various angles and corners of the hull 31 or deck 30 without necessitating the use of heat, special tools, etc.

Walls 14 and 16 also are sufficiently resilient so as to effectively absorb the shock of rubrail 10 contacting the hull of another boat, or wooden pilings, dock edges, etc. Thus, rubrail 10 is of simple, efficient, inexpensive and durable construction, can be installed rapidly by one skilled laborer in a fool-proof manner and is of attractive, smooth appearance.

It will be noted that in the particular orientation of rubrail 10 shown in FIG. 2, upper front wall 14 overlaps lower front wall 16 so as to prevent moisture from entering cavity 22. However, if for decorative or other purposes it is desired to reverse this overlap so as to provide the configuration shown in FIG. 3, wherein lower wall 16 overlaps upper wall 14, this can easily be done.

Figure 4:
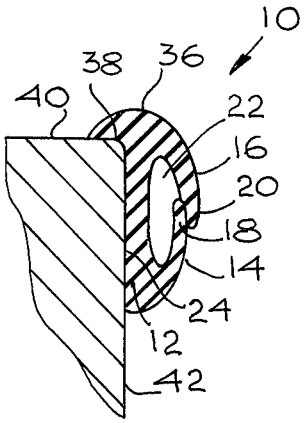
FIG. 4 is a schematic cross section showing the rubrail of FIG. 1 installed on a deck-hull configuration of the flush deck type, the rubrail being inverted from the position shown in FIGS. 2 and 3.
Figure 5:
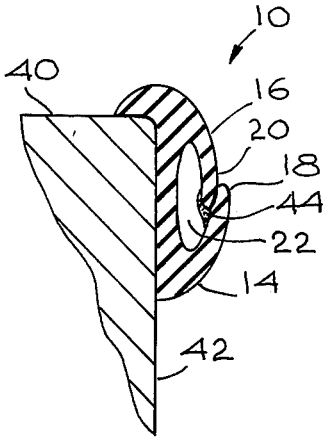
FIG. 5 shows the rubrail of FIG. 4 installed on a deck-hull construction of the flush deck type but with the lower front wall overlapping the upper front wall, in contrast to FIG. 4 and with the two front walls joined by adhesive.

FIGS. 4 and 5

Figure 3:
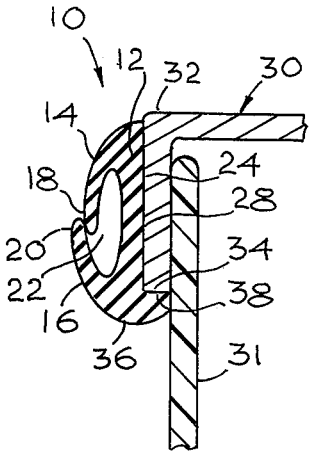
FIG. 3 is a schematic cross section of the rubrail of FIG. 2 shown installed on a deck-hull construction of the overlapping deck type, but with the lower front wall overlapping the upper front wall, in contrast to the arrangement of FIG. 2.

Rubrail 10 is shown schematically in FIG. 4 of the drawings in a position totally inverted from that of FIG. 3. Thus, in the orientation shown in FIG. 4, end wall 36 has its flat surface 38 resting on the upper surface 40 of a flush deck-hull configuration. Flat surface 24 of rear wall 12 abuts the portion 42 of the deck-hull construction which is below the top surface. It will be noted that, as in FIG. 3, front wall 16 overlaps 14, that is, free end 20 overlaps free end 18. The same rubrail 10 thus fits equally well with a flush-deck construction, as is shown in FIG. 4, as it does with the overlapping deck-hull construction shown in FIGS. 2 and 3.

In FIG. 5, rubrail 10 is shown in the same orientation with respect to surface 40 as shown in FIG. 4, except that front wall 14 and its free end 18 overlap front wall 16 and its free end 20, instead of the reverse. Moreover, a small amount of adhesive 44 is shown adhering to the inner surface of ends 18 and 20 so as to seal cavity 22 from moisture. Rubrail 10 can be secured to top surface 40 and depending wall portion 42 in the same manner as previously described for rubrail 10 in connection with FIGS. 1–3.

FIGS. 6 and 7

Now referring more particularly to FIG. 6 of the accompanying drawings, a second preferred embodiment of the improved reversible rubrail of the present invention is schematically depicted in cross section. Thus, a rubrail 50 is shown which includes an upstanding rear wall 52 and forwardly curved front walls 54 and 56, along with an end wall 58. Rubrail 50 differs only from rubrail 10 in that the free ends 60 and 62 of front walls 54 and 56, respectively, abut each other rather than overlap. A cavity 64 is defined by front walls 54 and 56 and rear wall 52. Rear wall 52 has a flat rear wall surface 66 and end wall 58 has a flat surface 68 which is at a 90° angle to and is connected with flat surface 66. Surface 68 abuts the lower edge 70 of the depending portion 72 of a deck 74 which overlaps a hull 76. Surface 66 abuts depending portion 72, as shown in FIG. 6. Rubrail 50 can easily be installed by adhesive or by bolts, screws, etc., as previously described for rubrail 10.

Rubrail 50 is as fully reversible (invertible) as is rubrail 10. Thus, in FIG. 7 rubrail 50 is shown installed on a deck-hull construction of the flush type so that flat surface 68 rests on the top surface 78 of that construction and that flat surface 66 abuts the depending portion 80 of that construction. Free ends 60 and 62 are cemented together by adhesive 82 to seal off cavity 64. Thus, rubrail 50 is equally usable with deck-hull constructions of the flush type and those of the overlapping deck type.

Various modifications, changes, alterations and additions can be made in the rubrail of the present invention, its components and parameters. All such modifications, changes, alterations and additions as are within the scope of the appended claims form part of the present invention.

What is claimed is:

1. An improved invertible rubrail for use with vessels with overlapping decks with planar surfaces and vessels with flush decks with planar surfaces, said rubrail comprising an elongated flexible resilient strip having:

(a) an upstanding rear wall with a continuous rear surface, the length of which is adapted to lie flush with the planar surface on which is it used;

(b) spaced first and second front walls connected to said rear wall adjacent to upper and lower ends of the rear wall, said two front walls projecting forward of said rear wall, having releasably contacting overlapping openable ends and defining with said rear wall a compressible cavity accessible through said openable ends; and, (c) an end wall connected at one of said ends of said rear wall and extending rearwardly thereof generally perpendicular thereto.

2. The improved rubrail of claim 1 wherein said rear wall is generally flat and vertical on the rear surface thereof and wherein said end wall is generally flat and horizontal on a surface thereof connecting with said flat surface of said rear wall.

3. The improved rubrail of claim 1 wherein said free end of said first front wall overlaps the free end of said second front wall.

4. The improved rubrail of claim 3 wherein said front walls are of sufficient resilience to permit said second front wall to be reflected forward so as to overlap said first front wall.

5. The improved rubrail of claim 1 wherein said front walls are arcuate in cross section.

6. The improved rubrail of claim 1 wherein said end wall includes a curved portion extending over said rear wall.

7. The improved rubrail of claim 2 wherein said flat surfaces of said end wall and said rear wall are perpendicular to each other, whereby said end wall and said rear wall are adapted to abut, cover and extend around a deck corner to protect the same.

8. The improved rubrail of claim 7 wherein said rubrail is flexible enough to bend around deck and hull corners.

* * * * *